United States Patent [19]

Lapeyre

[11] Patent Number: 4,732,115

[45] **Date of Patent: * Mar. 22, 1988**

[54] INTERVAL SPARK IGNITION COMBUSTION ENGINE

[75] Inventor: James M. Lapeyre, New Orleans, La.

[73] Assignee: The Laitram Corporation, Harahan, La.

[ * ] Notice: The portion of the term of this patent subsequent to Nov. 1, 2002 has been disclaimed.

[21] Appl. No.: 782,795

[22] Filed: Nov. 21, 1985

Related U.S. Application Data

[63] Continuation-in-part of Ser. No. 446,702, Dec. 3, 1982, Pat. No. 4,543,917, and a continuation-in-part of Ser. No. 237,667, Feb. 24, 1981, Pat. No. 4,566,408, which is a continuation of Ser. No. 97,955, Nov. 28, 1979, abandoned, which is a continuation of Ser. No. 890,980, Mar. 28, 1978, abandoned.

[51] Int. Cl.[4] ..... F02B 25/08

[52] U.S. Cl. ..... 123/51 B; 123/51 BD; 123/48 D

[58] Field of Search ..... 123/51 R, 51 B, 51 BB, 123/51 BD, 54 A, 74 A, 293, 54 R, 74 R

[56] References Cited

U.S. PATENT DOCUMENTS

| | | | |
|---|---|---|---|
| 657,226 | 9/1900 | Marmonier | 123/51 B |
| 1,925,086 | 9/1933 | Snyder | 123/48 D |
| 3,071,122 | 1/1963 | Lieberherr | 123/51 B |
| 4,543,917 | 10/1985 | Lapeyre | 123/51 BD |
| 4,566,408 | 1/1986 | Lapeyre | 123/51 BD |

FOREIGN PATENT DOCUMENTS

| | | | |
|---|---|---|---|
| 19677 | of 1913 | United Kingdom | 123/51 B |

*Primary Examiner*—Craig R. Feinberg
*Attorney, Agent, or Firm*—J. C. Kesterson

[57] ABSTRACT

A two stroke spark ignition engine requiring a minimum of one pair of cylinders is constructable in multiple cylinder pairs. Each cylinder contains two oppositely working pistons. Four pistons drive, without rocking couples, opposite sides of a single crankshaft having three crankpins. Two paired cylinders are interconnected through and share a common precombustion chamber insuring cylinder pressure equalization and require only one fuel injector and one spark plug. The valveless engine has piston controlled intake and exhaust ports and crank phasing insures that exhaust ports are opened and closed prior to the respective opening and closing of the intake ports rendering the uniflow scavenged cylinders superchargeable. The precombustion chamber is optionally made variable in volume to simultaneously provide a variable compression ratio to both cylinders without affecting piston geometry or stroke.

10 Claims, 24 Drawing Figures

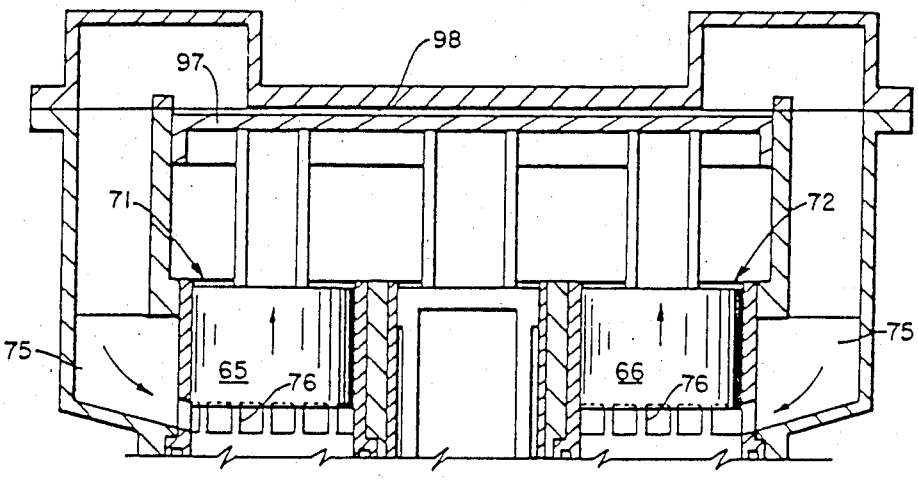
Fig. 12
Fig. 11
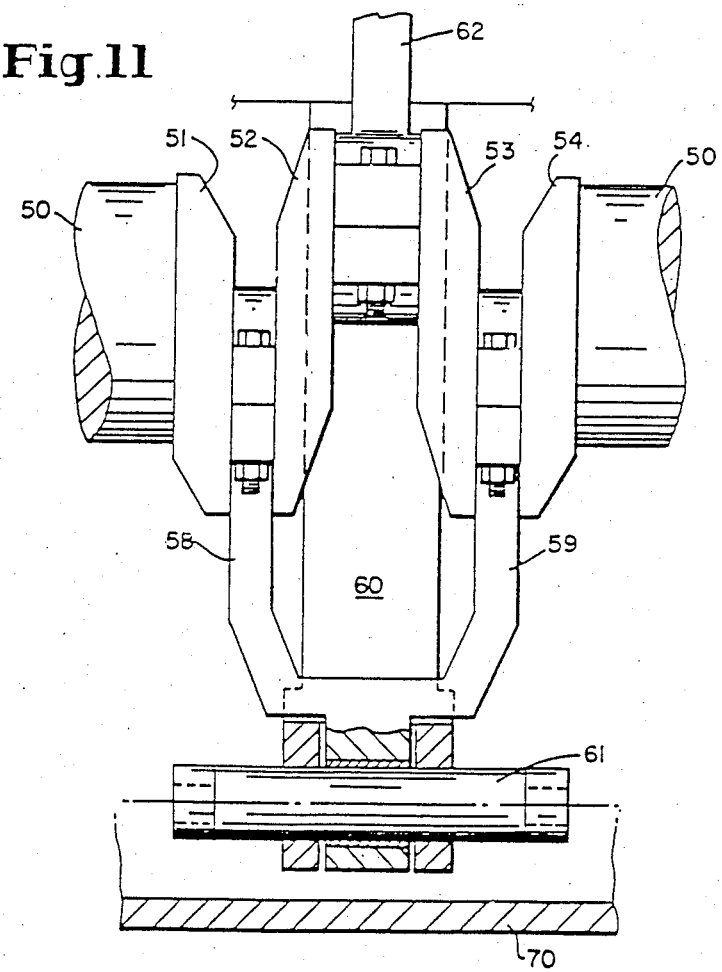

INTERVAL SPARK IGNITION COMBUSTION ENGINE

CROSS REFERENCE TO RELATED APPLICATION

This application is a continuation-in-part to my copending applications Ser. No. 446,702, filed 12/3/82 now U.S. Pat. No. 4,543,917, and Ser. No. 237,667 filed 2/24/81 now U.S. Pat. No. 4,566,408. Ser. No. 237,667 is itself a continuation of Ser. No. 097,955 filed 11/28/79, abandoned which was a continuation of Ser. No. 890,980 filed 3/28/78 abandoned.

TECHNICAL FIELD

This invention related to two cycle, valveless, single crankshaft spark ignition engines of the kind comprising a minimum of twospaced apart, axially coplanar, parallel, coterminous, open ended cylinders each containing two opposed pistons and each interconnected through a common precombustion chamber requiring a single fuel injector. The exhaust and intake ports are piston controlled so that the exhaust ports are opened and closed prior to the respective opening and closing of the intake ports. On opposite sides of the crankshaft and through the cylinders' open ends, like pistons are bridge connected to work in unison and utilizing the space between the cylinders, to symmetrically drive the single crankshaft orthogonally positioned between the cylinders' axes. The common precombustion chamber is optionally made with a variable volume to simultaneously provide a variable compression ratio to both cylinders.

BACKGROUND ART

Many engines having two oppositely working pistons within a single cylinder (opposed piston) have been invented and built. Many have proven to be inherently balanced and have high fuel and thermal efficiency proving the efficacy of the opposed piston concept. Except for one, those engines that have succeeded, as far as I know, have had multiple crankshafts. To my knowledge the only successful engine in use today which utilizes a single crankshaft, does so by using rocker levers to couple the pistons to the crankshaft. This engine however, works in multiples of single cylinders requiring two rocker levers and four connecting rods per cylinder thereby adding weight and increasing the number of working parts. The double number of connector rods all remain compressive members and therefore permit no reduction in weight.

In contradistinction the engine of the present invention uses two non-pivoting bridge members and three tensile connecting rods for each pair of cylinders resulting in better than 50% reduction in pivotally oscillating, drive-associated parts per working cylinder and permits lighter weight connecting rods which are all driven in tension rather than in compression.

In addition to the above reference the following list of patents is the best prior art on the hereinbefore described type of multiple cylinder opposed piston engines known to me as of the filing of this application.

| | | |
|---|---|---|
| British | 10,981 | of 1908 |
| British | 19,677 | of 1912 |
| British | 483,063 | of 1936 |

-continued

| | | |
|---|---|---|
| U.S. Pat. No. | 2,203,648 | June 4, 1940 |

The best prior art of the single cylinder opposed piston prior engines are:

| | |
|---|---|
| U.S. Pat. No. 1,629,878 | May 27, 1927 |
| U.S. Pat. No. 1,679,976 | Aug. 7, 1928 |
| U.S. Pat. No. 2,129,172 | Sept. 6, 1938 |
| U.S. Pat. No. 2,159,197 | May 23, 1939 |

Publication: Some Unusual Engines, by L. J. K. Setright, Mechanical Engineering Publications Ltd., London, England, 1975, pages 85–88.

My U.K. patent application No. GB 2017819A based on now abandoned Ser. No. 890,980 was published Oct. 10, 1979 and the patent issued Aug. 18, 1982.

Primarily, in my opinion, because they are overly complicated with levers, long reaching and vibration prone connecting rods, valves and valve actuators, or eccentric, twisting or rocking loads being applied to the crankshaft and/or to the engine structure, few if any of the above engines have passed the test of time.

SUMMARY OF THE INVENTION

The engine comprises, provided in pairs, a minimum of one pair of spaced apart parallel, axially coplanar, coextensive open ended cylinders each having toward each of its two ends intake and exhaust wall ports respectively. In a preferred embodiment each of the minimum two cylinders, in side to side relationship, share a common precombustion chamber through ducts entering each cylinder and at least one spark plug at approximate the cylinders' midlength. Each cylinder is provided with two oppositely working pistons, the motion of which controls the intake and exhaust ports in such a manner that the exhaust ports are opened and closed prior to the respective opening and closing of the intake ports. This provides for prior exhaust gas pressure release, subsequent end to end cylinder scavenging and superchargeability from a pressurized air supply. Importantly, the like pistons of each cylinder are bridge connected exteriorly of the cylinders' ends to move in unison. The movement of the two intake controlling pistons being transmitted from the bridge to a central crosshead (bridge guide means) extending into a hollow guideway located between the spaced apart cylinders, the crosshead being pivotaly connected by a pivotal tension rod to a single central crank pin of the single crankshaft. The movement of the two exhaust controlling pistons is ransmitted to two coaxial crank pins spacially astride the oppositely angled to the single central crank pin. The latter connections are made optionally by a single yoked or by two discrete and separated pivotal tension rods (the preferred method) directly to the pivot carried by the member bridging the exhaust controlling pistons. Thus, rotational moments are simultaneously delivered in balanced fashion to opposite sides of the crankshaft without rocking couples. Because of the common precombustion chamber through which the cylinders are interconnected, the cylinders' pressure are equalized and a single fuel injector and a spark plug are required to fire the four pistons. The precombustion chamber is optionally provided with a variable volume control, to simultaneously provide an equalized variable compression ratio in each of the two cylinders.

The primary object of the present invention is to provide a 2-cycle valveless, single crankshaft, spark ignition engine which can be cleanly scavenged, easily supercharged and of such simple design and contruction that reliability is enhanced permitting unattended engine operation for long periods in remote areas where only fuel need regularly be supplied.

Another object of the invention is to provide an engine wherein the internal forces and loads resulting from the engine's operation are as near balanced as possible so as to minimize main bearing loads and main bearng wear, thereby prolonging main bearing life.

Another object of the invention is to provide a spark ignition engine wherein the operating forces ar ebalancedly and symmeetrically applied to the crankshaft so as to minimize crankshaft fatigue and to provide a smooth output torque.

Another object of the present invention is to provide an engine of reasonably high power and efficiency with respect to weight and bulk so as to premit ease of transportability to remote areas.

A still further object of the invention is to provide a spark ignition engine having as few wearing parts as practicable so as to minimize spare parts inventories and expedite worn parts replacement.

A still further object of the invention is to provide an engine which is ideally suited for use where constant loads and speeds are the normal operating mode such as driving irrigation and flood control pumps and electrical generators.

A still further object of the invention is to provide an engine which may be uncomplicatedly adapted to have a variable compression ratio so as to provide for easy starting at a high compression ratio and for running under load at a lesser compression ratio, and to permit operation with fuels requiring differing compression ratios.

BRIEF DESCRIPTION OF THE DRAWINGS

FIG. 11 is an enlarged fragmentary vertical sectional view with parts broken away and parts shown in section of one form of crankshaft attachment to the exhaust bridge.

FIG. 12 is an enlarged fragmentary vertical sectional view with parts broken away and parts shown in section of one form of air compressor driven by the intake bridge to supply air to the cylinders.

BEST MODE FOR CARRYING OUT THE INVENTION

Figure 23:
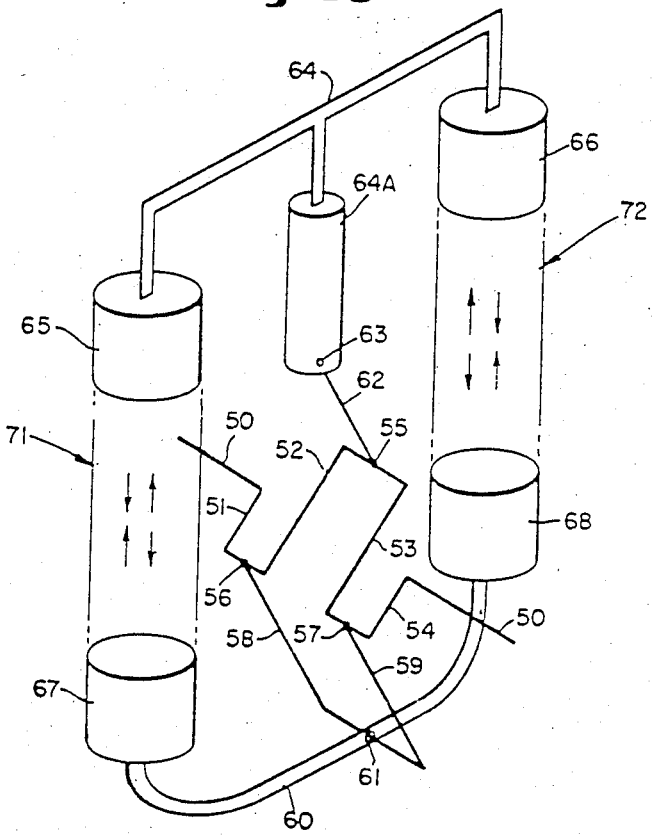
FIG. 23 is a schematic perspective view of the crankshaft of my invention being driven by the intake and exhaust bridge connectors.

The basic drive elements of my 2 cylinder 4 piston engine and my 4 cylinder 8 piston engine will be understood from referring to FIG. 23 wherein crankshaft 50 has four crank arms 51, 52, 53, 54. Connecting crank arms 52, 53 is a crank pin 55 while crank arms 51, 52 and crank arms 53, 54 are connected by crank pins 56, 57 which are coaxial. Connecting rods 58, 59 are secured to crank pins 56, 57 at one end and to an exhaust bridge 60 by exhaust bridge pivot 61.

Crank pin 55 has one end of connecting rod 62 secured thereto while the other end of rod 62 is pivoted at 63 to the intake bridge crosshead 64A which is connected rigidly to bridge 64 and driven by intake pistons 65, 66. The exhaust bridge 60 is driven by exhaust pistons 67, 68.

The two bridges 62 and 60 in reciprocation cause the crank shaft 50 to rotate through the drive of the connecting rods.

Figure 1:
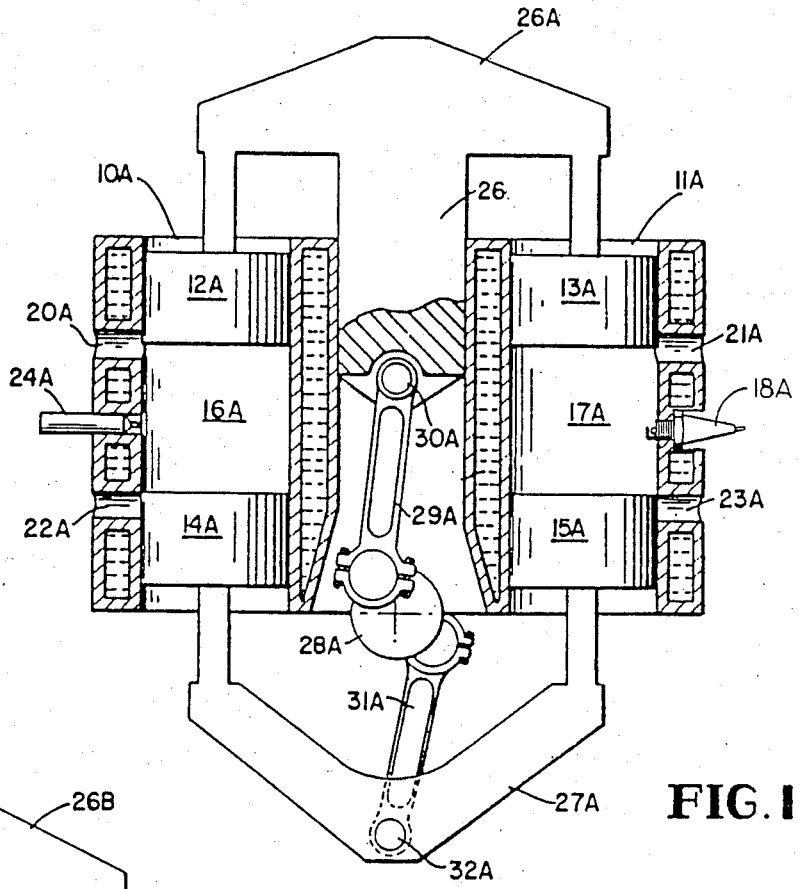
FIG. 1 is a vertical sectional view through one embodiment of my multiple cylinder opposed piston two cycle engine in which the crankshaft centerline is positioned coplanar with the plane of the one pair of ends of the two cylinders.

Referring now to FIG. 1, a form of engine is shown as having cylinders 10A, 11A, having single ended intake controlling pistons 12A, 13A secured to a piston bridging means 26A having a vertical slide member 26B. A pair of single ended exhaust controlling pistons 14A, 15A are secured to a piston bridging means 27A. Each cylinder has air intake ports 20A, 21A at their upper portion and exhause ports 22A, 23A at their lower portion, the fuel injectors 24A, and spark plug 18A lying therebetween. In this embodiment the crankshaft 28A has its centerline positioned coplanar with the plane of one pair of ends of the two cylinders 10A, 11A. Spark plugs 18A and 19A enter the cylinders 16A and 17A at a central position in a manner similar to the fuel injectors 24A and 25A.

In this embodiment the crankshaft 28A is connected through connecting rods 29A, 31A which are pivotally connected to the piston bridging means 26A, 27A at pivots 30A, 32A.

Figure 2:
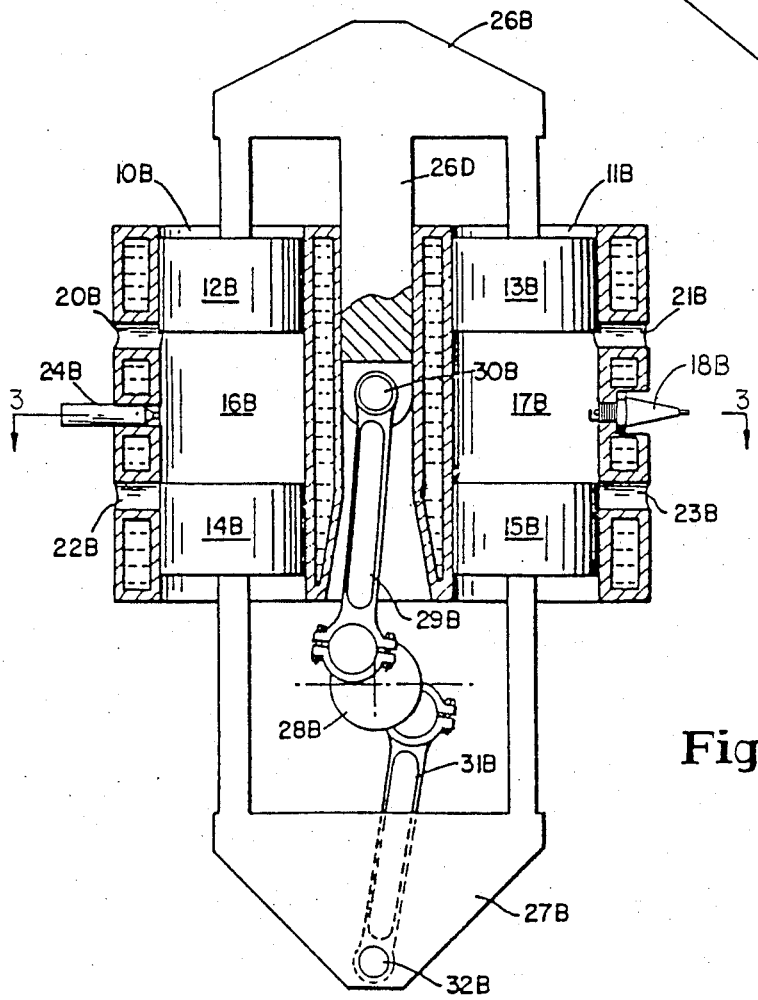
FIG. 2 is a vertical section through another embodiment of my invention with the centerline of the crankshaft lying below the bottom of one pair of ends of the two cylinders.
Figure 3:
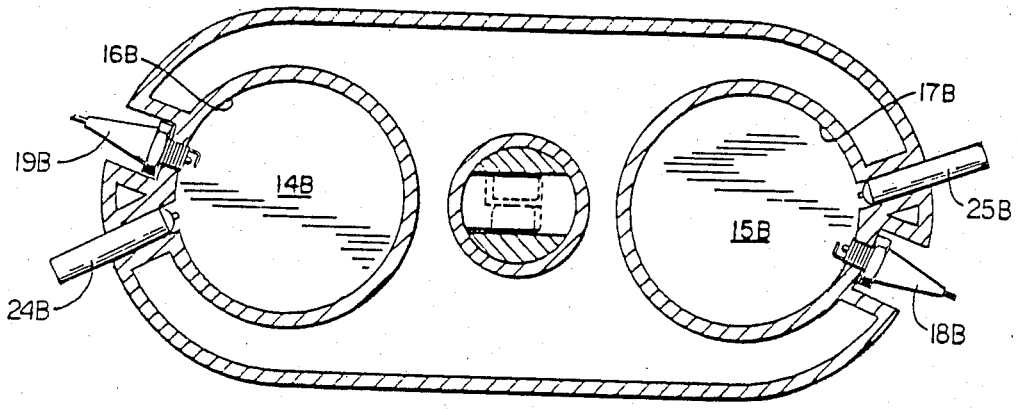
FIG. 3 is a horizontal section taken on the line 3—3 in FIG. 2.

Referring now to FIGS. 2 and 3, another modified form of engine is shown as having cylinders 10B, 11B, having single ended intake controlling pistons 12B, 13B secured to a piston bridging means 26B having a vertical slide member 26D. A pair of single ended exhaust controlling pistons 14B, 15B are secured to a piston bridging means 27B. Each cylinder has air intake ports 20B, 21B at their upper portion and exhaust ports 22B, 23B at their lower portion, the fuel injectors 24B, 25B and the spark plugs 18A and 18B lying therebetween. In this embodiment the crankshaft 28B has its centerline positioned outside the space defined by the planes of said cylinder ends. The crankshaft 28B is connected through connecting rods 29B, 31B which are pivotally connected to the piston bridging means 26B, 27B at pivots 30B, 32B.

Figure 4:
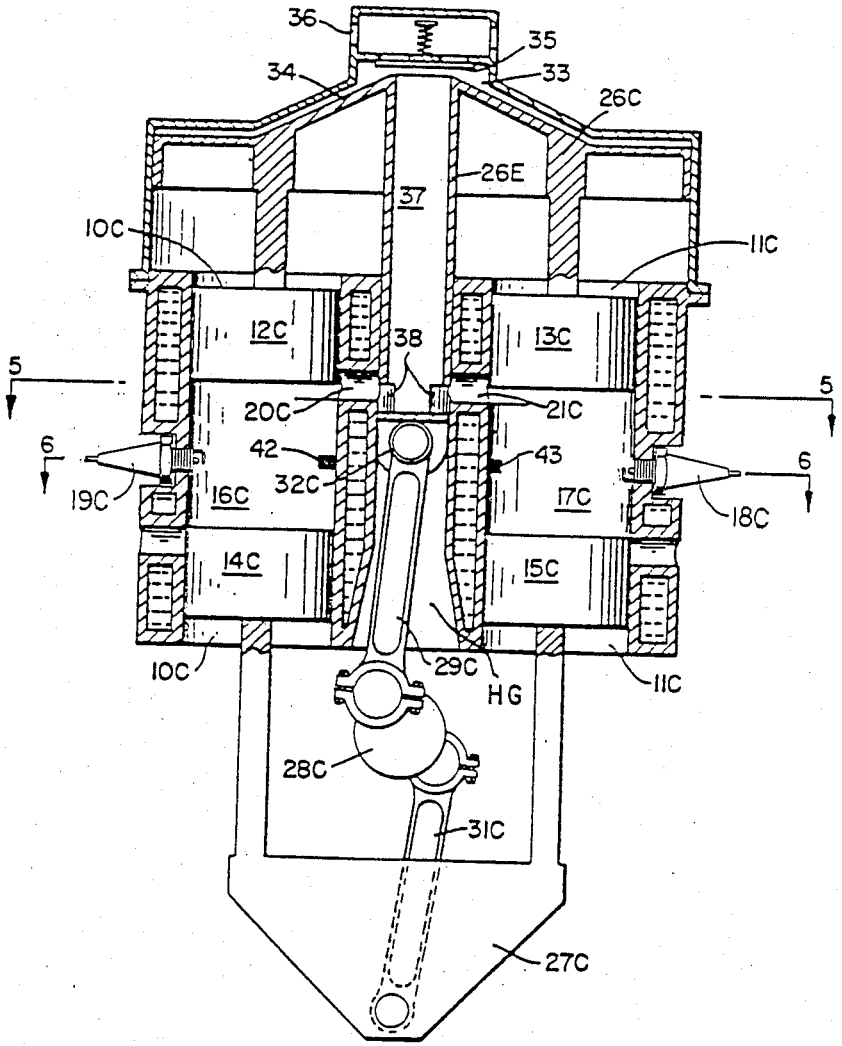
FIG. 4 is a vertical section through another embodiment of my invention having an air compressor piston at the top of the cylinders having an air manifold between the two cylinders and communicating intake air to both cylinders.
Figure 5:
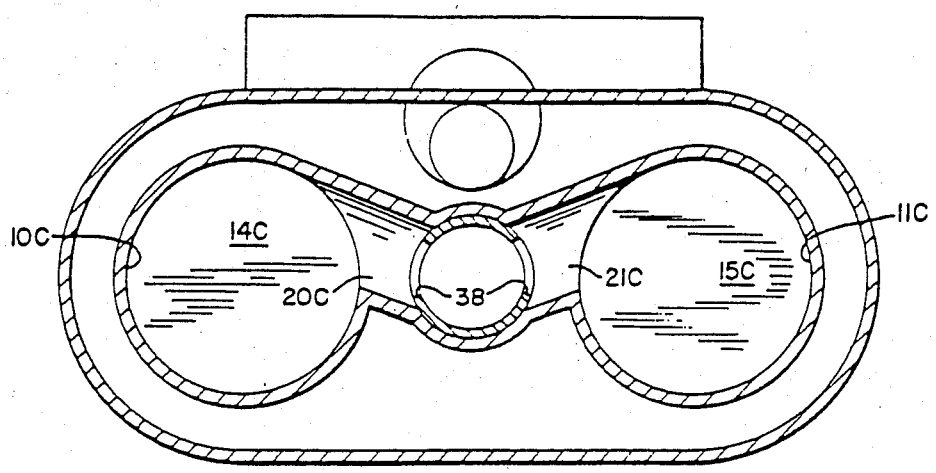
FIG. 5 is a horizontal section taken on line 5—5 in FIG. 4.
Figure 6:
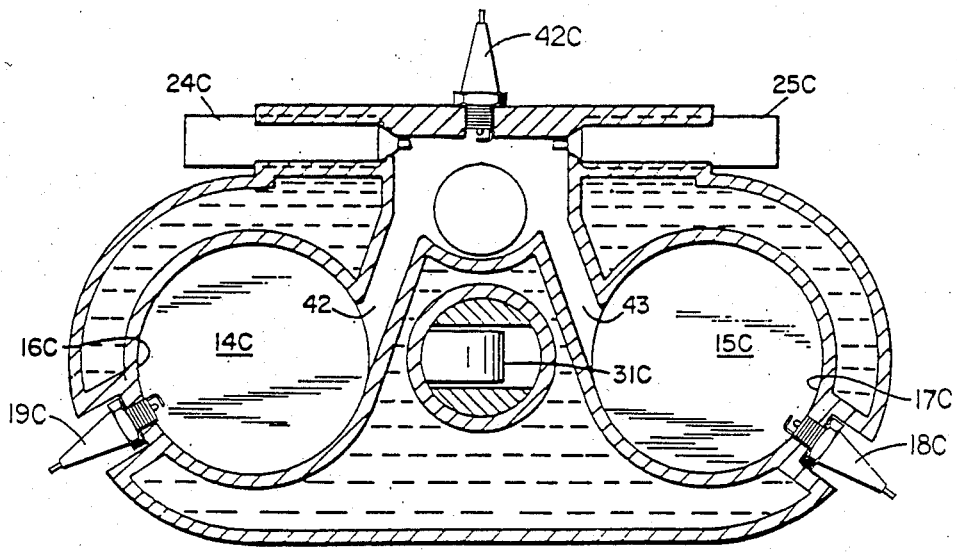
FIG. 6 is a horizontal section taken on the line 6—6 in FIG. 4.

Referring now to FIGS. 4, 5 and 6, a further modification of my engine is shown as having a pair of vertically positioned cylinders 10C, 11C horizontally displaced. The upper part of each cylinder has single ended intake controlling pistons 12C, 13C secured to a piston bridging means 26C having a vertical slide member 26E which operates an air compressor 33 which pumps air through air intake ports 20C and 21C into the combustion chambers 16C, 17C. Positioned in the lower portion of cylinders 10C, 11C are exhaust port controlling pistons 14C, 15C which are connected to the piston bridging means 27C through the open ends of the cylinders 10C, 11C. As the air compressor piston 34 goes down valve 35 opens and admits air through port 36. When the air compressor piston goes up, valve 35 seats and air is forced down hollow shaft 37 through air delivery ports 38 into the cylinder air intake ports 20C, 21C. In this embodiment the crankshaft 28C is driven by connecting rods 29C, 31C, rod 31C being pivotally connected to piston bridging means 27C while rod 29C is connected pivotally at 32C to the base of the hollow shaft 37. The shaft 37 reciprocates each time the air intake pistons 12C, 13C reciprocate as does air compressor piston 34.

As shown in FIG. 6 the fuel injectors 24C, 25C are positioned to inject fuel into a precombustion chamber common to combustion chambers 16C and 17C positioned midway in cylinders 10C and 11C and connected to said combustion chambers through ducts 42 and 43. Also as shown spark plugs 18C, 19C and 42C ignite the fuel and air mixture during the compression stroke in a manner well known to those skilled in the art. According to the embodiment shown, spark plug 42C is located in the precombustion chamber, and may be set to fire a few milliseconds before spark plugs 18C and 19C located in the combustion chambers 14C and 15C.

Figure 7:
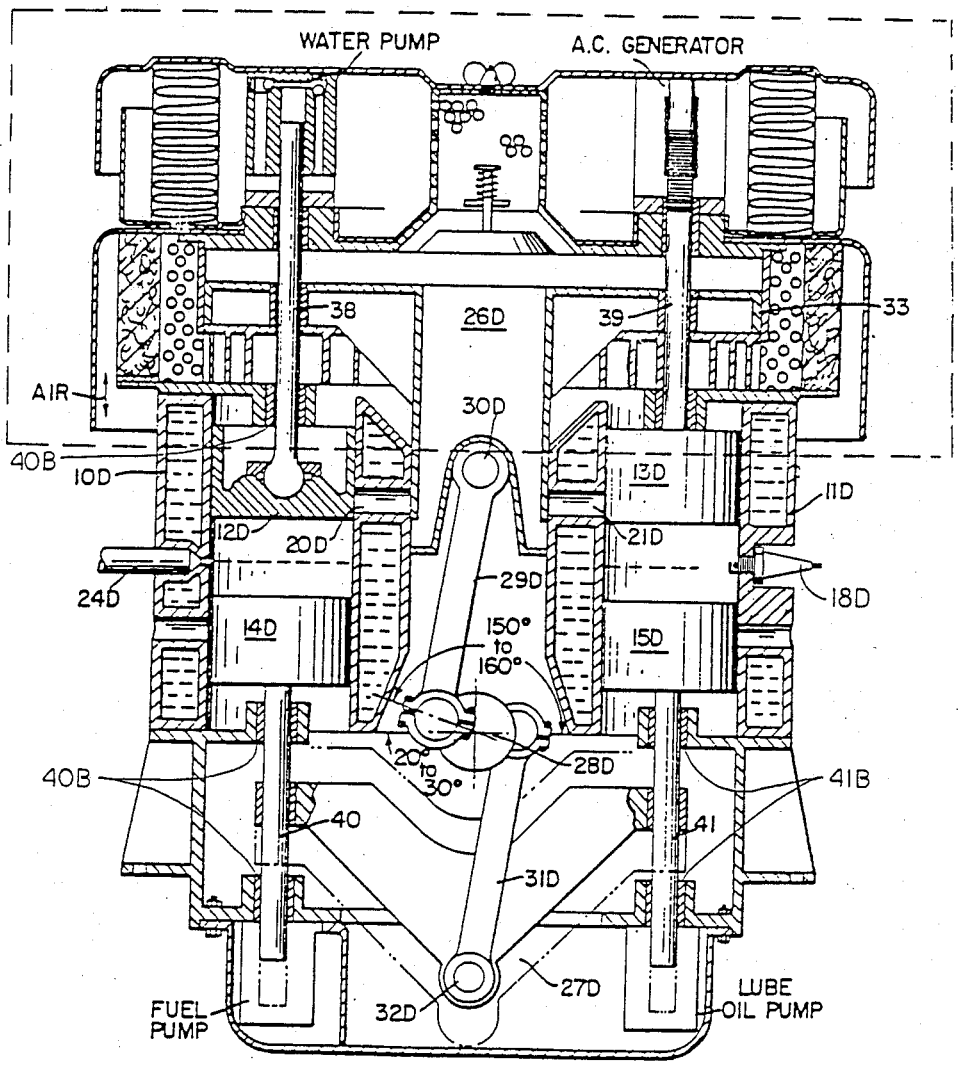
FIG. 7 is a vertical section taken through a further modified form of my engine similar to FIG. 4 including guide means for the piston bridging means to minimize lateral movement of both the piston bridging means as well as lateral movement of said pistons.

Referring now to FIG. 7, a pair of spaced apart cylinders 10D, 11D have air intake control pistons 12D, 13D in their upper portion and exhause port controlling pistons 14D, 15D in their lower portion. Fuel injectors 24D, 25D and spark plugs 18D and 19D are positioned between the air intake and exhaust ports. In this embodiment the piston bridging means 26D is substantially T-shaped. The leg of the T is pivotally connected to a connecting rod 29D at the upper end at pivot 30D and the leg of the T is hollow to provide an air delivery manifold to supply pressurized air from the compressor 33 tothe air intake openings 20D, 21D. The pistons 12D, 13D are secured tothe top or cross member of the T-shaped piston bridging means by fastening means 38, 39.

The lower pistons 14D, 15D which control exhaust ports are secured to the lower piston bridging means 37D by fastener means 40, 41 and lateral thrust slide bearings are shown at 40B and 41B.

The crankshaft 28D is driven by connecting rods 29D, 31D which are pivotally connected to the piston bridging means 26D, 37D, at 30D, 32D.

Referring now to FIGS. 8 through 14, the two cylinder 4 piston form of engine will be described.

Figure 8:
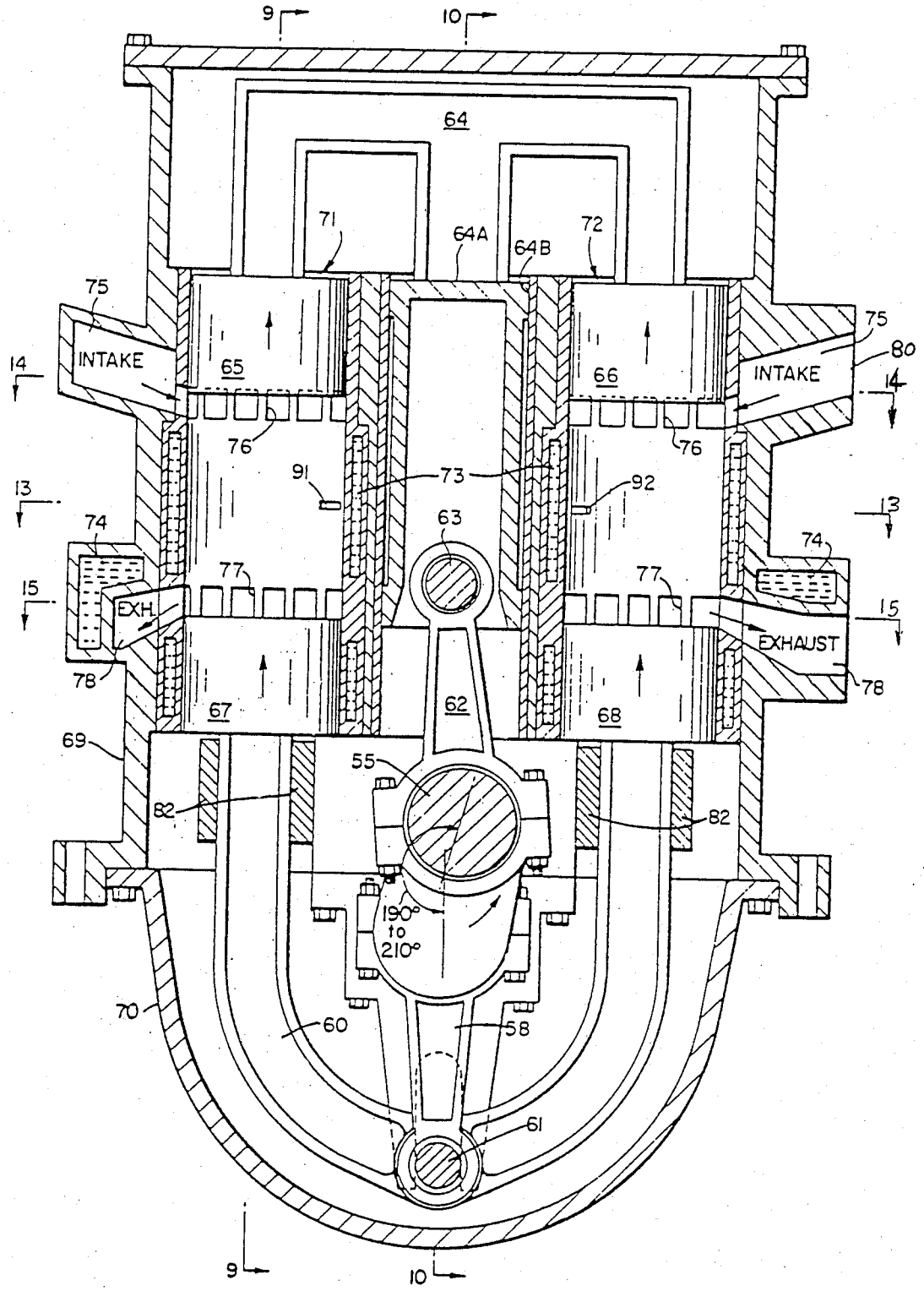
FIG. 8 is a vertical transverse section taken through a 2 cylinder, 4 piston engine in accordance with the present invention.
Figure 9:
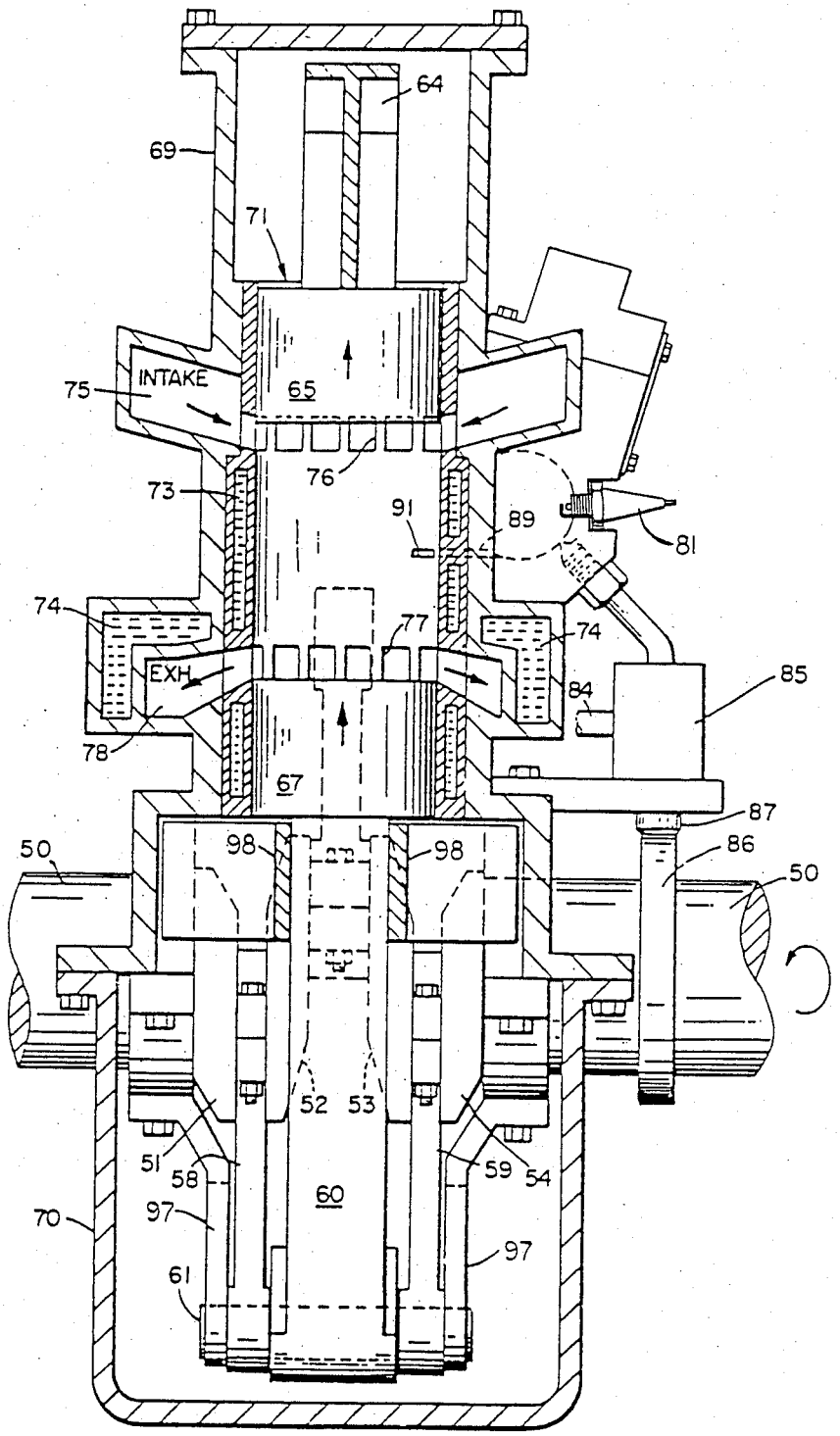
FIG. 9 is a vertical sectional view through FIG. 8 taken on the line 9—9 in FIG. 8.
Figure 10:
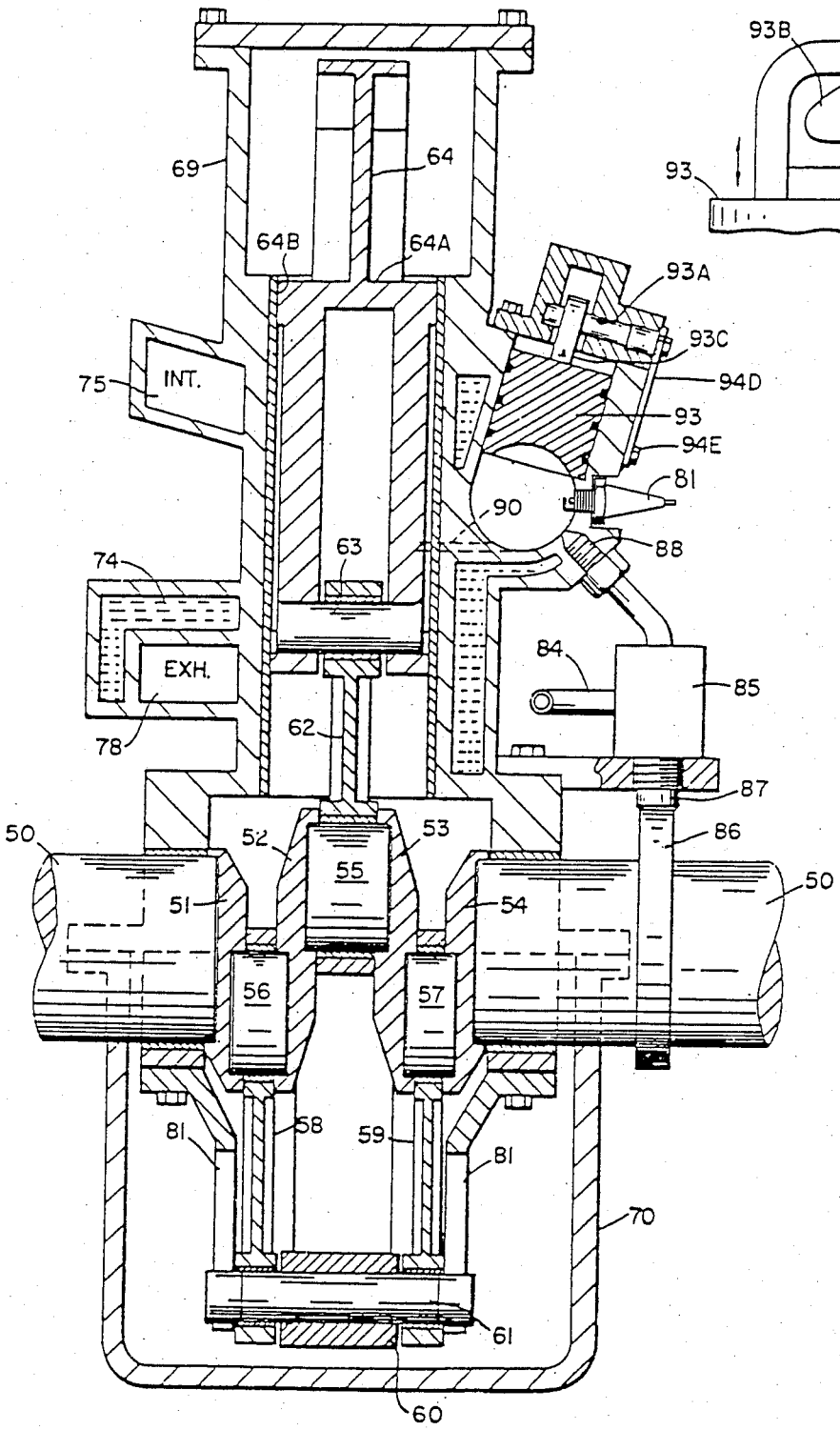
FIG. 10 is a vertical longitudinal section taken on the line 10—10 in FIG. 8.

The engine casement is best seen in FIGS. 8, 9 and 10 having a cylinder block 69 and crank case 70. The cylinder block 69 has two cylinders 71, 72. Cooling water jackets 73, 74 are provided for the cylinders and exhaust. Air intake ducts 75 are shown communicating with the cylinder air intake ports 76 while cylinder gas exhaust ports 77 in the cylinder wall communicates with exhaust ducts 78.

The intake pistons 65, 66 are connected through the intake bridge 64 to the crosshead 64A reciprocatable within bearing 64B and theexhaust pistons 67, 68 are secured to the exhaust bridge 60.

Figure 18:
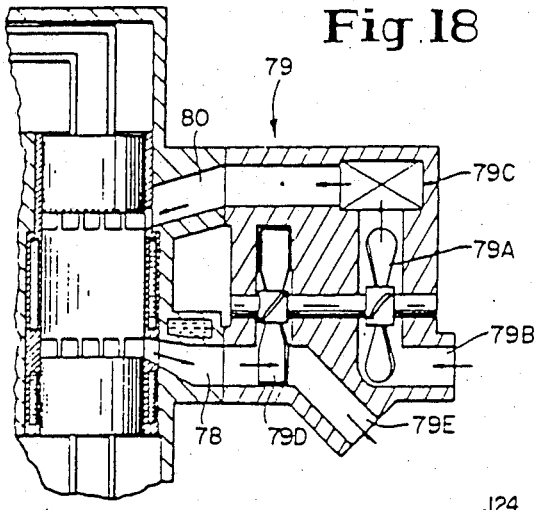
FIG. 18 is a fragmentary vertical sectional schematic view taken through an optional turbocharger for the air intake of either the two or four cylinder engine of my invention.

Intake air for cylinders 71, 72 may be supplied as shown in FIG. 18, by the turbocharger 70 which has an intake fan 79A which receives intake air from port 79B and thence passes the air from fan 79A through cooler 79C to air intake 80 of FIG. 8. The exhaust gases issuing from duct 78 drive a turbine 79D which in turn drives the fan 79A. The exhaust gas is discharged through port 79E. (FIG. 18)

As shown in FIG. 8, the angle from the exhaust crank pin axis to the rotationally following intake pin axis is greater than 180°. In this way the intake pistons will follow or "lag" behind the exhaust pistons by an angle equal to that angle which is in excess of 180°. Actual experiments have yet to confirm the best lag angle but it is estimated to be between 10 and 30 degrees. Whereas I do not wish to be restricted to a specific "intake following angle" a good estimate would be 190° to 210°.

Figure 13:
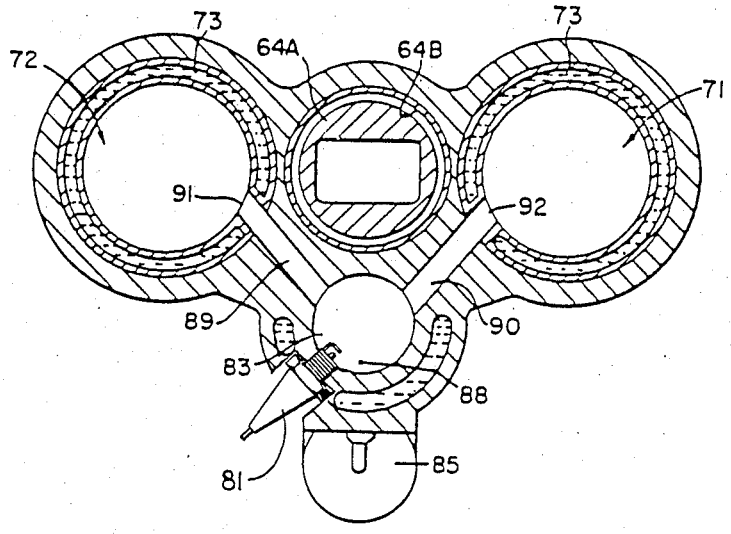
FIG. 13 is a horizontal section taken through the precombustion chamber of the 2 cylinder 4 piston engine of FIG. 8 along the line 13—13 in FIG. 8.
Figure 14:
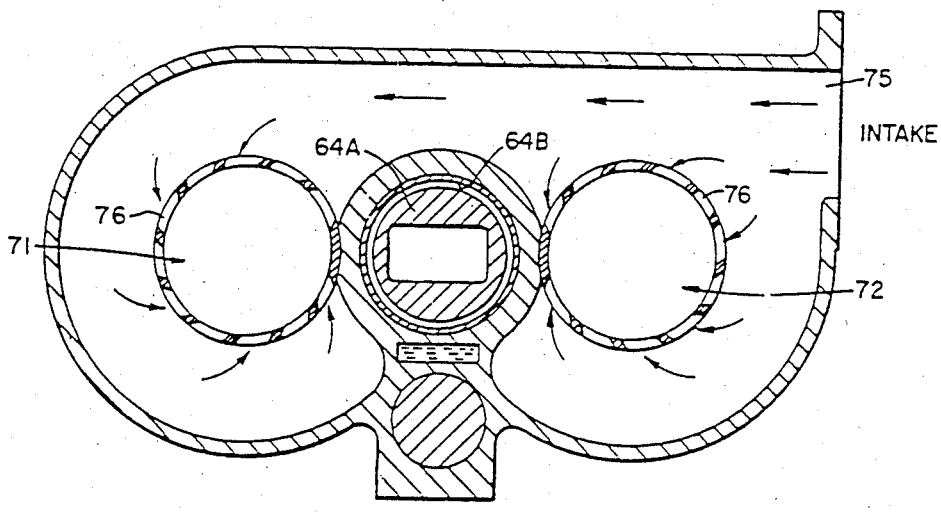
FIG. 14 is a horizontal section taken through the air intakes of the engine of FIG. 8 along the line 14—14 of FIG. 8.
Figure 15:
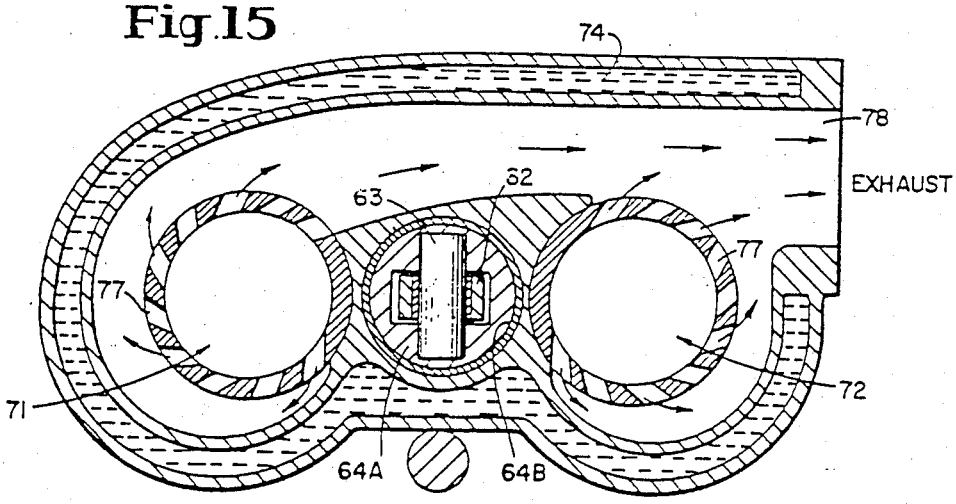
FIG. 15 is a horizontal section taken through the exhaust outlets of the engine of FIG. 8 along the lines 15—15 of FIG. 8.
Figure 22:
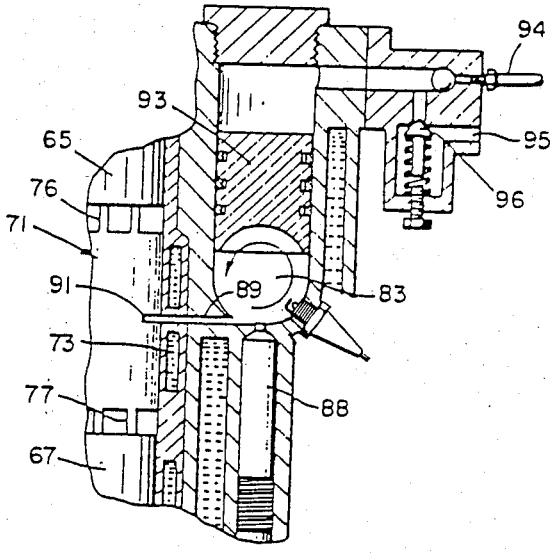
FIG. 22 is a fragmentary vertical sectional view taken through a modified hydraulically controlled variable volume precombustion chamber.

Referring now to FIGS. 9, 10 and 12 the fuel system and precombustion chamber will be described. A precombustion chamber 83 is shown the volume of which may be varied as shown in FIG. 22. The fuel is supplied by line 84 to a fuel injector pump 85 actuated by a cam 86 secured on crank shaft 50 to actuate cam follower 87 causing fuel to be delivered to the fuel injector 88 which injects fuel into the preswirl or precombustion chamber 83 which as shown in FIG. 13 through ducts 80, 90 to cylinders 71, 72 at ports 91, 92. At the appropriate moment during the compression stroke spark plug 82 is fired to initiate the power stroke. Although a single spark plug is shown in the embodiment it will be appreciated that the three spark plugs such as shown in FIG. 6 could be used.

Figure 10A:
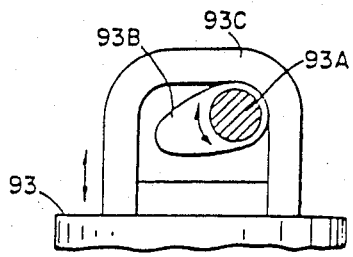
FIG. 10A is a vertical sectional view showing the cam control setting for the precombustion chamber variable setting.

The precombustion chamber volume may be varied as shown in FIG. 10 by a piston 93 which may be cam set as shown in FIG. 10A wherein the piston 93 may be moved into or out of the precombustion chamber 83 by a cam shaft 93A having a lobe 93B to raise and lower a cam follower 93C to raise and lower the piston 93 upon rotation of the cam shaft 93A by lever 94D which may be locked in place by set screw 94E when the desired setting is attained.

As shown in FIG. 22 the precombustion chamber volume may be hydraulically varied automatically dependent upon engine loading through high pressure hydraulic line 94, there being a crank case return line 95 under the control of a pop-off valve 96 to make the setting responsive to engine loading to move piston 93 toward or away from the precombustion chamber 83.

The intake air to be supplied to the cylinders 71, 72 may be by tghe turbocharger shown in FIG. 18 or by modification of the intake bridge as shown in FIG. 12 where the top of the intake bridge 64 is modified to form a piston 97 within an air pump 98 to supply intake air to cylinders 71, 72.

The difference between the exhause bridge drive in FIGS. 10 and 11 is that in FIG. 10 the exhaust bridge connecting rods 58, 59 are individually connected whereas in FIG. 11 the rods 58, 59 are yoked for connection to the exhaust bridge pivot 61.

Figure 16:
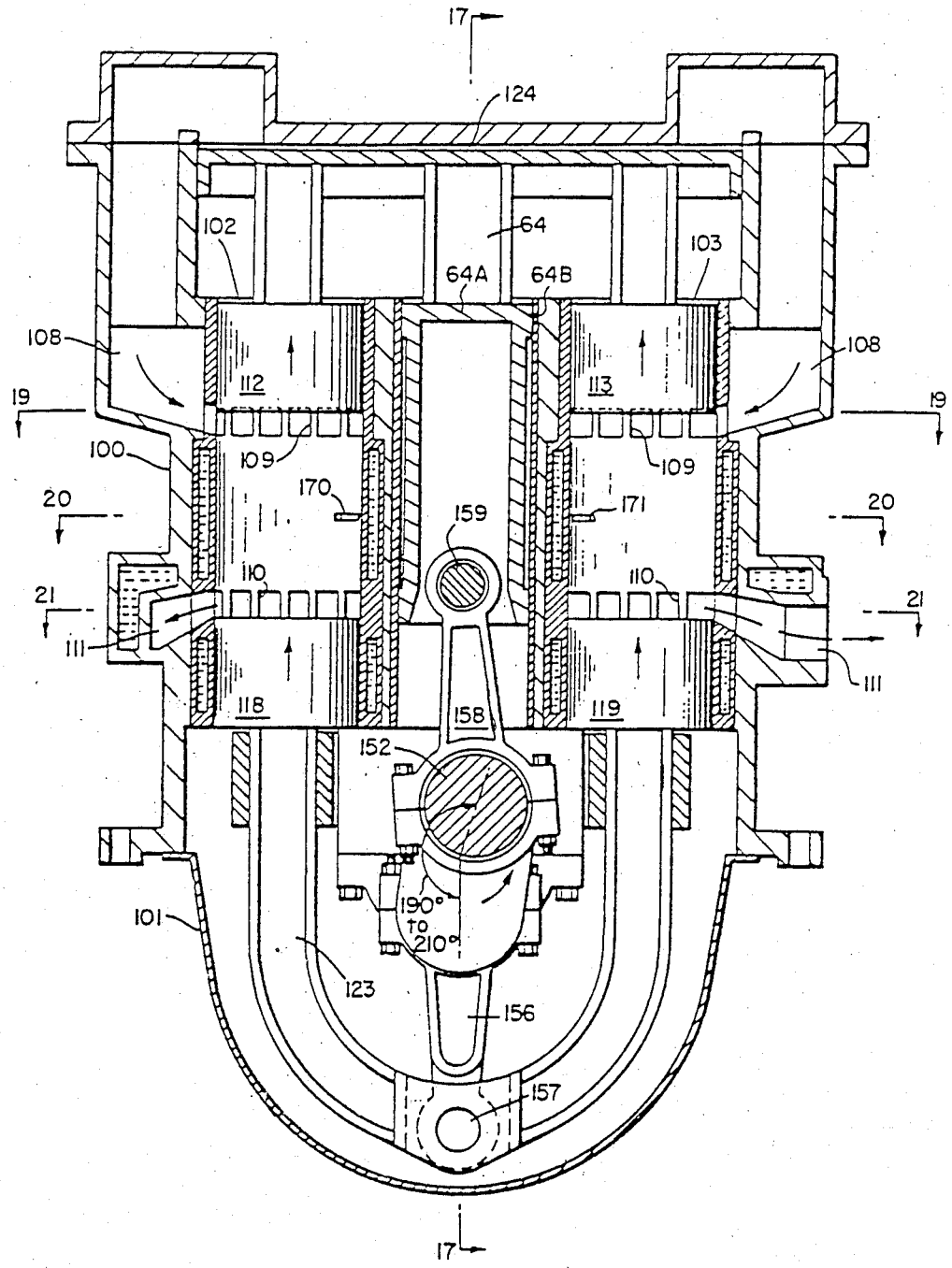
FIG. 16 is a vertical transverse cross section taken through a 4 cylinder 8 piston embodiment of my invention.
Figure 17:
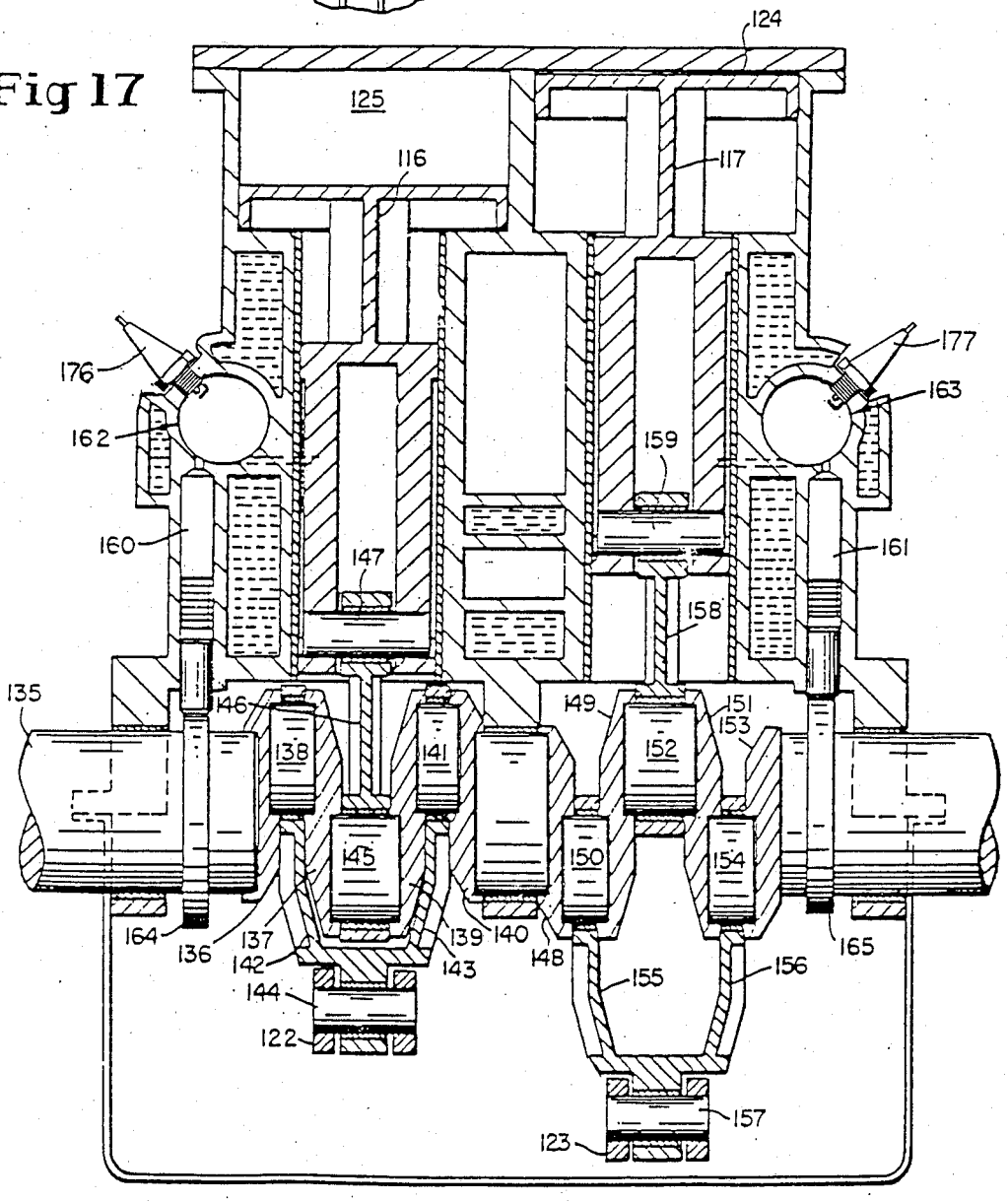
FIG. 17 is a vertical longitudinal cross sectional view taken through the 4 cylinder 8 piston engine of FIG. 16 along the axis of the crankshaft.
Figure 19:
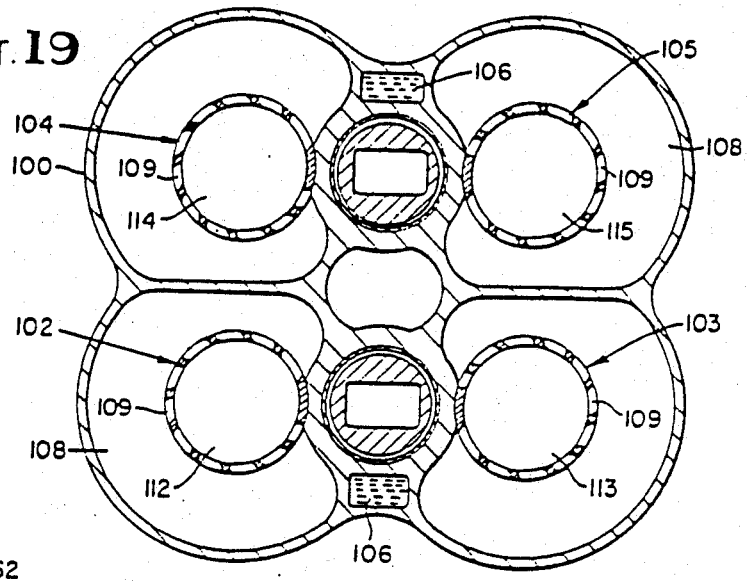
FIG. 19 is a horizontal section taken through the air intakes of the engine of FIG. 16 taken on the line 19—19 of FIG. 16.
Figure 19:
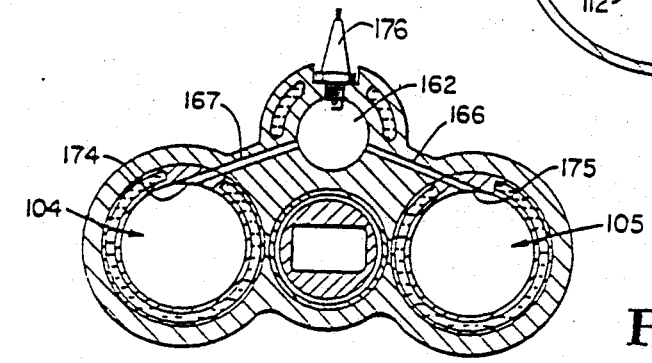

The 4 cylinder 8 piston embodiment of FIGS. 16 through 21 will now be described wherein the engine casement is best seen in FIGS. 16 and 17 having a cylinder block 100 and crank case 101. The cylinder block 100 has 4 cylinders 102, 103, 104, and 105. Cooling water jackets 106, 107 are provided for the cylinders and exhaust. Air intake ducts 18 are shown communicating with the cylinder intake ports 109 while cylinder air exhaust ports 110 in the cylinder wall communicates with exhaust duct 111, best seen in FIG. 21.

The intake pistons 112, 113, 114 and 115 are connected to intake bridges 116, 117 and the exhaust pistons 118, 119, 120 and 121 are secured to the exhaust bridges 122, 123.

Intake air for cylinders 102, 103, 104 and 105 may be supplied as shown in FIGS. 16 and 17 by air pumps 124, 125 which as shown in FIG. 16 supplies ai to the intake ducts 108 of cylinders 102, 103, 104 and 105.

Figure 21:
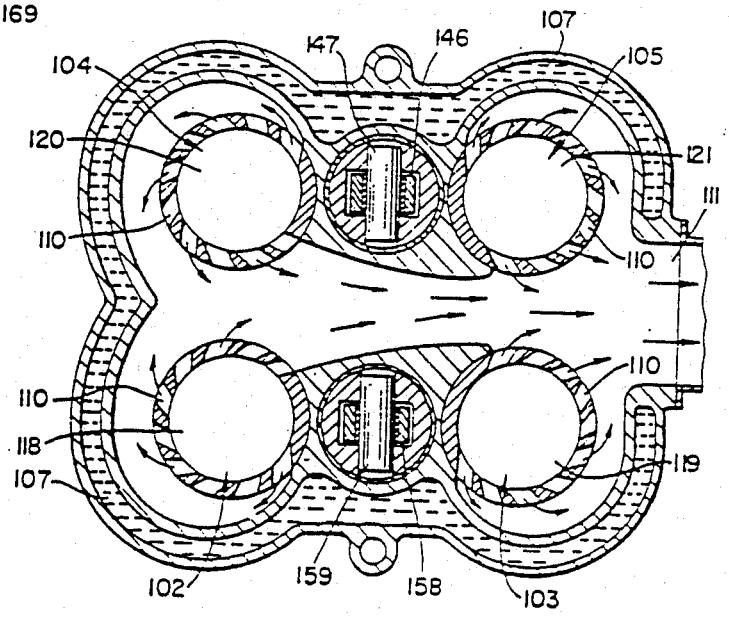
FIG. 21 is a horizontal section taken through the exhaust ports of the engine of FIG. 16 taken on the line 21—21 of FIG. 16.

The exhaust gas from each cylinder 102, 103, 104 and 105 exists through ports 110 in FIG. 21 and through the exhaust duct 111.

Exhaust bridges 122, 123 are provided for each pair of exhaust pistons 118, 119, 120 and 121 which are secured to each pair of pistons.

Referring now to FIG. 17, the 4 cylinder 8 piston crankshaft 135 is shown. From left to right crank arms 136, 137 have exhaust crank pin 138 therebetween while crank arms 139, 140 have exhaust crank pin 141 therebetween. The crank pins 138 and 141 carry connecting rods 142, 143 which are connected to exhaust bridge pivot 144 carried by the exhaust bridge 122.

Crank arms 137, 139 have intake crank pin 145 therebetween. inake crank pin 145 has one end of intake connecting rod 146 connected thereto while the other end of intake rod 146 is connected to the intake bridge pivot 147 carried by the intake bridge 116. Continuing on to the right in FIG. 17 crank arms 148, 149 have exhaust crank pin 150 therebetween while crank arms 149, 151 have intake crank pin 152 therebetween. Crank arms 151 and 153 has exhaust crank pin 154 therebetween. Exhaust crank pins 150 and 154 carry connecting rods 155, 156 which are connected to the exhaust bridge pivot 157 carried by the exhaust bridge 123. Crank arms 149, 151 have intake crank pin 152 therebetween. Intake crank pin 152 has one end of intake connecting rod 158 connected thereto while the other end of intake rod 158 is connected to the intake bridge pivot 159 carried by the intake bridge 117.

Figure 20:
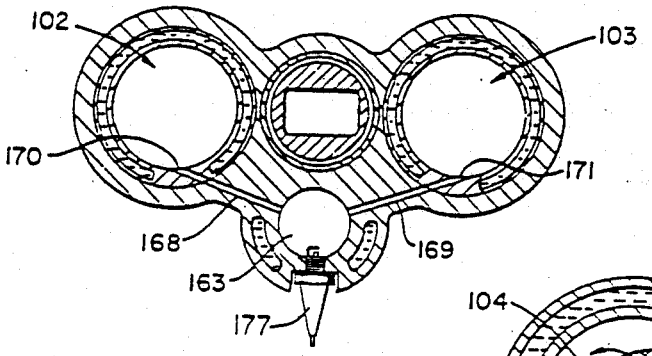
FIG. 20 is a horizontal section taken through the precombustion chamber of the engine of FIG. 16 taken on the line 20—20 in FIG. 16.

Referring now to FIGS. 17 and 20, the fuel injection spark plugs and precombustion system will be described. Injectors 160, 161, one for each pair of cylinders delivers fuel to the precombustion chambers 162, 163. The injectors 160, 161 are actuated by cams 164, 165 secured for rotation with crankshaft 135. Each of the precombustion chambers 162, 163 as shown in FIG. 210, is connected to a pair of cylinders by ducts 166, 167 as for chamber 162 and by ducts 168, 169 for chamber 163. The fuel entrance port to cylinder 102 is shown at 170 from chamber 163 while the fuel injection port to cylinder 103 is shown at 171 from chamber 163. Chamber 162 is connected to the other pair of cylinders by ducts 166, 167 discharging into the other pair of cylinders through ports 174, 175, best seen in FIG. 20. Spark plugs 176 and 177 as shown within precombustion chambers 162, 163, and ignite the fuel-air mixture in a well known manner.

Whereas all of the parts of my engine are individually old, except perhaps for the parts comprising the variable precombustion chamber, the geometry of their combination is new and unique and permits the elimination of many parts conventionally employed so that fewer parts are needed to construct a high reliability engine at lower cost.

What is claimed:

1. A two cycle internal combustion spark ignition engine comprising in combination:

(a) minimum of two side by side spaced apart axially parallel cylinders, (b) a hollow guideway parallel to and positioned between said cylinders, (c) one variable volume combustion chamber, (d) air intake porting located in each cylinder wall at a first end of said combustion chamber, having an upstream end and a downstream end, (e) exhaust porting located in each cylinder wall at a second end of said combustion chamber, (f) means for delivering fuel into said cylinders approximately midway of the length of said combustion chamber, and when said combustion chamber is at its approximate minimum volume, said means including a precombustion chamber common to and in communication with said combustion chamber of each of said cylinders, said precombustion chamber being positioned outside of the plane of the axes of said cylinders, (g) at least one spark plug for igniting a mixture of fuel and air in said combustion chamber, (h) one cylindrical single headed pressure sealing valveless air intake controlling piston coaxial with and slidably mounted within each of said cylinders, said piston having its head end facing the combustion chamber and its connector end facing a first non-combustion end of said cylinder, said piston opening and closing said downstream end of said air intake porting as it slides past said air intake porting, (i) a rigid non-pivotal piston bridging means spanning from piston axis to piston axis of said air intake controlling pistons, (j) dual rigid and operationally non-pivotal piston connector means extending from said piston bridging means, said piston connector means being adapted to link said piston bridging means with said air intake controlling pistons at said pistons' connector ends, (k) bridge guide means extending from said piston bridging means into said hollow guideway for opening and closing said upstream end of said air intake porting as it slides past said air intake porting, said bridge guide means terminating in a connecting rod pivot means, (l) one cylindrical single headed pressure sealing valveless exhaust controlling piston coaxial with and slidably mounted within each of said cylinders, said piston having its head end facing said combustion chamber and its connector end facing a second non-combustion end of said cylinders, said piston being adapted to open and close said exhaust porting as it slides past said exhaust porting, (m) a second rigid non-pivotal piston bridging means spanning from piston axis to piston axis of said exhaust controlling pistons, (n) second dual rigid and operationally non-pivotal connector means extending from said second piston bridging means, said second piston connector means being adapted to link said second piston bridging means with said exhaust controlling pistons at said pistons' connector ends, (o) a single crankshaft located between said parallel axes of said cylinders and between the two piston bridging means, the axis of said crankshaft being at right angles to the plane of said cylinders' parallel axis, (p) at least two connecting rods between said two piston bridging means, one of said connecting rods being connected to pivot means of said bridge guide means and to said crankshaft and a second connecting rod connected to said second piston bridging means and to said crankshaft, (q) said connections to said crankshaft being made to angularly spaced cranks carried by said single crankshaft, said angular spacing of said cranks being such that as the crankshaft rotates through 360°, said two piston bridging means and their respectively connected pistons are forced to move in opposite directions, the two air intake controlling pistons being reciprocated in unison and the two exhaust controlling pistons likewise being reciprocated in unison and wherein said air intake controlling pistons are forced to lag behind said exhaust controlling pistons in such a manner that said exhaust porting is forced to open prior to the opening of said air intake porting and said exhaust porting is forced to close prior to the closing of said air intake porting.

2. The engine of claim 1 wherein the location of said single crankshaft axial centerline is between said two piston bridging means and outside the space defined by the planes of said cylinders' end.

3. The engine of claim 1 further comprising at least one air compressing means adapted to deliver compressed air simultaneously to said combustion chambers via said air intake porting.

4. A two cycle internal combustion spark ignition engine comprising in combination:

(a) a minimum of two side by side spaced apart axially parallel cylinders, (b) a hollow guideway positioned between and parallel to said spaced apart cylinders, (c) one variable volume combustion chamber contained within each of said cylinders, (d) air intake porting located in each cylinder wall at a first end of said combustion chamber, (e) air compressing means adapted to be in communication with said air intake porting for simultaneously forcing air into each of said combustion chambers via said air intake porting, (f) exhaust porting located in each cylinder wall at a second end of said combustion chamber, (g) means for delivering fuel into said cylinders approximately midway of the length of said combustion chamber, when said combustion chamber is at its approximate minimum volume, said means including a pre-combustion chamber common to and in communication with each combustion chamber of each of said cylinders, said pre-combustion chamber being positioned outside of the plane of the axes of said cylinders, (h) at least one spark plug for igniting a mixture of fuel and air in said combustion chamber, (i) one cylindrical single headed pressure sealing valveless air intake controlling piston coaxial with the slidably mounted within each of said cylinders, said piston having its head end facing the combustion chamber and its connector end facing a first non-combustion end of said cylinder, said piston being adapted to open and close said air intake porting as it slides past said air intake porting, (j) a rigid non-pivotal piston bridging means spanning from piston axis to piston axis of said air intake controlling pistons, (k) dual rigid and operationally non-pivotal piston connector means extending from said piston bridging means, said piston connector means being adapted to link said piston bridging means with said air intake controlling pistons at said pistons' connector ends, (l) bridge guide means extending from said piston bridging means into said hollow guideway, said bridge guide means terminating in a connecting rod pivot means, (m) one cylindrical single headed pressure sealing valveless exhaust controlling piston coaxial with and slidably mounted within each of said cylinders, each piston having its head end facing said combustion chamber and its connector end facing a second non-combustion end of said cylinder, said piston being adapted to open and close said exhaust porting as it slides past said exhaust porting, (n) a second rigid non-pivotal piston bridging means spanning from piston axis to piston axis of said exhaust controlling pistons, (o) second dual rigid and operationally non-pivotal connector means extending from said second piston bridging means, said second piston connector means being adapted to link said second piston bridging means with said exhaust controlling pistons at said pistons' connector ends, (p) a single crankshaft located between said parallel axes of said cylinders and between the two piston bridging means, the axis of said crankshaft being at right angles to the plane of said cylinders' parallel axis, (q) at least two connecting rods between said two piston bridging means, one of said connecting rods being connected to pivot means of said bridge guide means and to said crankshaft, and a second connecting rod connected to said second piston bridging means and to said crankshaft, (r) said connections to said crankshaft being made to angularly spaced cranks carried by said single crankshaft, said angular spacing of said cranks being such that as the crankshaft rotates through 360°, said two piston bridging means and their respectively connected pistons are forced to move in opposite directions, said two air intake controlling pistons being reciprocated in unison and said two exhaust controlling pistons likewise being reciprocated in unison and wherein the said air intake controlling pistons are forced to lag behind said exhaust controlling pistons in such a manner that said exhaust porting is forced to open prior to the opening of said air intake porting and the said exhaust porting is forced to close prior to the closing of said air intake porting.

5. An engine as claimed in claim 4 wherein said air compressing means is a turbocharger having a turbine driven compressor supplying air to the air intake porting in each cylinder wall at the first end of said combustion chamber and the exhaust gases issuing from the exhaust porting in each cylinder wall at the second end of said combustion chamber drives said turbine.

6. An engine as claimed in claim 5 wherein the means for varying the volume of said pre-combustion chamber is a piston mechanically positionable to vary the volume of said pre-combustion chamber to maintain a constant pre-combustion chamber volume independent of any variations or surges in engine loading.

7. An engine as claimed in claim 5 further comprising means for varying the volume of said pre-combustion chamber.

8. An engine as claimed in claim 7 wherein said means for varying the volume of said pre-combustion chamber comprises a piston subjected at one end to hydraulic fluid responsive to oil pressure variable in response to engine loading.

9. A two cycle internal combustion spark ignition engine comprising in combination:

(a) a minimum of two side by side spaced apart axially parallel cylinders, (b) a hollow guideway positioned between and parallel to said spaced apart cylinders, (c) one variable volume combustion chamber contained within each of said cylinders, (d) air intake porting located in each cylinder wall at a first end of said combustion chamber, (e) said intake porting of each cylinder adapted to communicate with a compressed air supply, said supply being common to both cylinders, (f) exhaust porting located in each cylinder wall at a second end of said combustion chamber, (g) means for deliverying fuel into said cylinders approximately midway the length of said combustion chamber, when said combustion chamber is at its approximate minimum volume, said means including a pre-combustion chamber common to and in communication with each combustion chamber of each of said cylinders, said pre-combustion chamber being positioned outside of the plane of the axes of said cylinders, (h) at least one spark plug for igniting a mixture of fuel and air in said combustion chamber, (i) one cylindrical single headed pressure sealing valveless air intake controlling piston coaxial with and slidably mounted within each of said cylinders, said piston having its head end facing the combustion chamber and its connector end facing a first non-combustion end of said cylinder, said piston being adapted to open and close said air intake porting as it slides past said air intake porting, (j) a rigid non-pivotal piston bridging means spanning from piston axis to piston axis of said air intake controlling pistons, (k) dual rigid and operationally non-pivotal piston connector means extending from said piston bridging means, said piston connector means being adapted to link said piston bridging means with said air intake controlling pistons at said pistons' connector ends, (l) bridge guide means extending from said piston bridging means into said hollow guideway, said bridge guide means terminating in a connecting rod pivot means, (m) one cylindrical single headed pressure sealing valveless exhaust controlling piston coaxial with and slidably mounted within each of said cylinders, said piston having its head end facing said combustion chamber and its connector end facing a second non-combustion end of said cylinder, said piston being adapted to open and close said exhaust porting as it slides past said exhaust porting, (n) a second rigid non-pivotal piston bridging means spanning from piston axis to piston axis of said exhaust controlling pistons, (o) second dual rigid and operationally non-pivotal connector means extending from said second piston bridging means, said second piston connector means being adapted to link said second piston bridging means with said exhaust controlling pistons at said pistons' connector ends, (p) a single crankshaft located between said parallel axes of said cylinders and between the two piston bridging means, the axes of said crankshaft being at right angles to the plane of said cylinders' parallel axis, (q) one central crank pin and two oppositely angled coaxial crank pins carried by said crankshaft said central crank pin being positioned across the plane of the cylinders' axes and the two oppositely angled crank pins being positioned to each side of the plane of the cylinders' axes, (r) three connecting rods positioned between said two piston bridging means, one of said connecting rods being connected to pivot means of said bridge guide means and to said central crank pin of said crankshaft, and the two connecting rods being connected to the single pivot means of said second piston bridging means and to said two coaxial crank pins, (s) said crank pins of said crankshaft being angularly spaced such that as the crankshaft rotates through 360°, said two piston bridging means and their respectively connected pistons are forced to move in opposite directions, said two air intake controlling pistons being reciprocated in unison and said two exhaust controlling pistons likewise being reciprocated in unison and wherein the said air intake controlling pistons are forced to lag behind said exhaust controlling pistons in such manner that said exhaust porting is forced to open prior to the opening of said air intake porting and said exhaust porting is forced to close prior to the closing of said air intake porting.

10. The engine of claim 9 wherein said precombustion chamber is adapted to be variable in volume.

* * * * *